United States Patent [19]

Phelan

[11] 3,949,851

[45] Apr. 13, 1976

[54] MOTION TRANSLATION MEANS FOR HIGH SPEED PRINTER PRINT HEAD

[75] Inventor: Roy Lawrence Phelan, Centerville, Ohio

[73] Assignee: Victor Comptometer Corporation, Chicago, Ill.

[22] Filed: Jan. 24, 1975

[21] Appl. No.: 543,881

[52] U.S. Cl. ..... 197/1 R; 74/27

[51] Int. Cl.[2] ..... B41J 1/24

[58] Field of Search ..... 197/1 R, 60, 82; 101/93.15, 93.37; 74/22 R, 26, 27, 49, 53, 519

[56] References Cited

UNITED STATES PATENTS

| | | | |
|---|---|---|---|
| 2,911,085 | 11/1959 | Leathers | 197/1 R |
| 3,628,645 | 12/1971 | McFeaters et al. | 101/93.15 X |
| 3,776,340 | 12/1973 | Moser | 197/1 R |
| 3,817,365 | 6/1974 | Zimmermann | 197/1 R |
| 3,854,563 | 12/1974 | Cowardin et al. | 197/1 R |

*Primary Examiner*—Ralph T. Rader
*Attorney, Agent, or Firm*—McCaleb, Lucas & Brugman

[57] ABSTRACT

A high speed serial printer having a platen or backing for print-receiving media and printing members for effecting display of indicia in printing lines on the media, including a print head having a printing end and selectively operable printing members; motion translation mechanism for oscillating the printing end of the print head laterally relative to the platen from a starting position for the length of a printing line and return to the starting position, which includes a pivot for the print head having an axis of rotation perpendicular to the plane of lateral movement of the print end, and drive mechanism for oscillating the print head about the pivot to minimize the force required to move the printing end of the print head, swinging of the print head on a pivot being materially more efficient than sliding the entire print head along a printing line.

8 Claims, 5 Drawing Figures

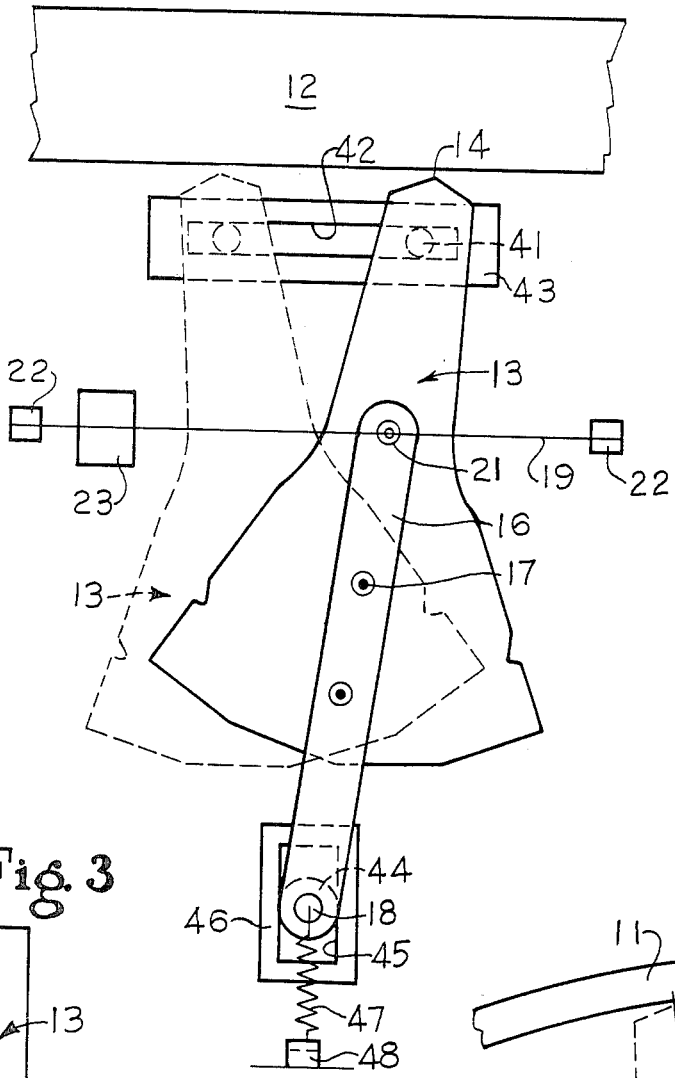
Fig. 4
Fig. 3
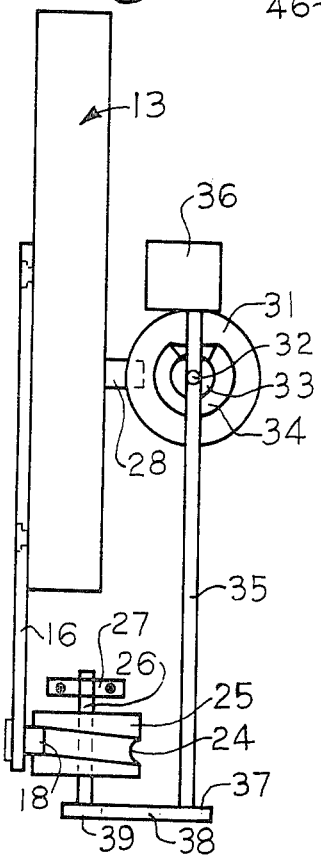
Fig. 1
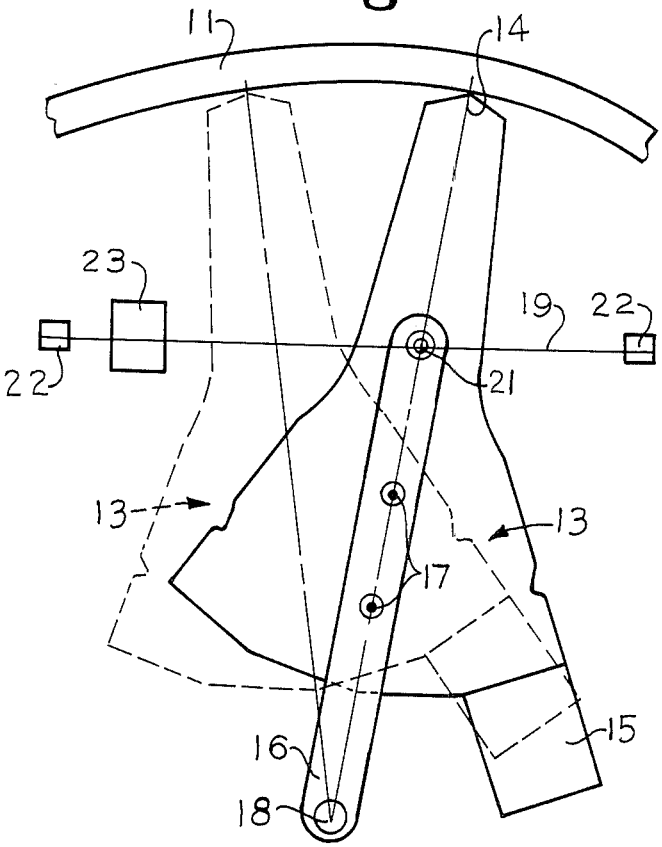

MOTION TRANSLATION MEANS FOR HIGH SPEED PRINTER PRINT HEAD

BACKGROUND OF THE INVENTION

1. Field of the Invention

This invention relates in general to high speed printers and, more particularly, to means for moving the print head therein from a starting position across a printing line and returning it to the starting position.

2. Description of the Prior Art

High speed serial printers, both "on-the-fly" and "step-by-step" types, have been meeting with increasing popularity for printing outputs from computers, calculators and other equipment, wherein a print head is moved across a printing line and returned to starting position, and the transport or driving mechanisms for the print heads have proved to be most important. This is true in the many different types of both "impact" and "non-impact" printers. For quality printing, a uniform rate of movement of the print head during printing is essential, but this has been found to be most difficult to attain when extremely high speeds are desired. In this regard, the mass of the print head clearly plays a critical part, even for those printers that are to be used with small devices, such as electronic calculators and instrumentation. This follows from the customary practice of translating the entire print head and its supporting structure across the printing line.

Many types of motion translation means for high speed printer print heads have been developed, some examples of this continuing effort to solve the problems involved being found in the following U.S. Patents.

U.S. Pat. No. 3,300,017 employs a very complex structure (FIGS. 6, 15, 16) for translating print head 334 by a toothed belt 338 in response to energization of electromagnet 615 to unlatch lever 602 so spring 605 will press shoe 601 onto the free end of clutch spring 600 to effect rotation of drive pulley 581. Cam surface 617 resets lever 602 after one revolution of pulley 581, thus releasing the drive of the latter, and a coil spring in the pulley returns the print head to starting position.

U.S. Pat. No. 3,628,645 discloses a drive shaft having two helical grooves in which a pin on the print head rides so that the head is moved from a starting position transversely across the printing line and returned at a higher speed to the starting position in response to rotation of the shaft at a constant speed in only one direction.

U.S. Pat. No. 3,795,298 uses a carriage for the print head which is traversed along a printing line by an endless belt threaded around an idler wheel and a drive wheel, the latter being coupled to a reversible stepping motor.

U.S. Pat. No. 3,572,238 discloses a cable "step-by-step" transverse drive of the printing end of the print head and a transverse following movement of a slide on guide rods, the other end of the print head being pivotally mounted on the slide, with springs interconnecting the slide and the print head, so that the normally undesirable frequency of oscillation is increased to a value the patentee finds more favorable, the printing end being given a step-by-step travel across the printing line and the supporting slide moving transversely with the head as a unit.

U.S. Pat. No. 3,776,340 provides what amounts to step-by-step movements of the printing end of a wire print head relative to the platen, while the print head is moved by a continuous and uninterrupted feed of a head-supporting block parallel to the platen and transversely along a printing line, to prevent relative transverse movement between the printing needles and the platen at the instant of printing impact of the needles. To accomplish this, a shaft through the headsupporting block is provided with an eccentric rotatable in the print head near its printing end, and that shaft is rotated by a motor which also is carried by the headsupporting block, the motor additionally rotating a driving gear meshing with a stationary rack to effect the transverse movement of the block.

In U.S. Pat. No. 3,817,365, but that print head is pivotally supported on a lever which is pivotally mounted on a carriage for moving the print head toward and away from the printing plane and the carriage is moved along guide rails parallel to that plane, the movement of the print head relative to the carriage being employed to withdraw the print head from the printing plane during carriage return following completion of a line of printing and to return it to printing position when the carriage arrives in the beginning of line position.

Thus it will be seen that while pivotal mounting of such a print head has been suggested, it has not been for the purpose of controlling or effecting reciprocable translation of the printing end of the print head to traverse a printing line or area.

SUMMARY OF THE INVENTION

This invention minimizes the inertia of the print head, thus making higher and more uniform speed of the printing end attainable in a high speed printer and reducing the space required for the printer, by mounting the print head on a pivot having an axis substantially perpendicular to the plane of lateral movement required of the printing end and oscillating the print head about that pivot.

If the print head pivot is fixed, the oscillation of the printing end will be confined to the arc of a circle, thereby requiring an arcuate printing plane or platen which presents some difficulties in handling the paper or print-receiving media. However, this invention also comprehends mounting the print head pivot for shifting movement relative to a platen defining a straight printing line, and means for moving the pivot in synchronism with the oscillation of the print head to maintain the printing end thereof spaced substantially the same distance from the platen at all times. For use with a straight, rather than a curved, platen, simple pivotal movement of the print head could be employed to effect uniform printing by varying the distance the printing means, such as wires, are moved toward and away from the platen at the different incrementally angular positions thus assumed by the print head, but such variation of the printing movement distance would require additional control means that would greatly complicate the structure.

The actual drive or motion translation means may take different forms, some of which are illustrated herein, such as a cam for oscillating the print head and another cam for moving the pivot toward and away from the platen with the cams driven synchronously with each other, or constraining the printing end to straight linear travel by guide means and guiding and spring loading the pivot for following shifting toward and away from the platen, or a lever system interconnecting the print head and the shiftable pivot.

In the drawings:

FIG. 1 is a diagrammatic plan view of a print head embodying the invention mounted on a fixed pivot with means for oscillating the head about that pivot to swing its printing end relative to an arcuate platen;

FIG. 3 is a side elevation as seen along the line 3—3 of FIG. 2;

Figure 5:
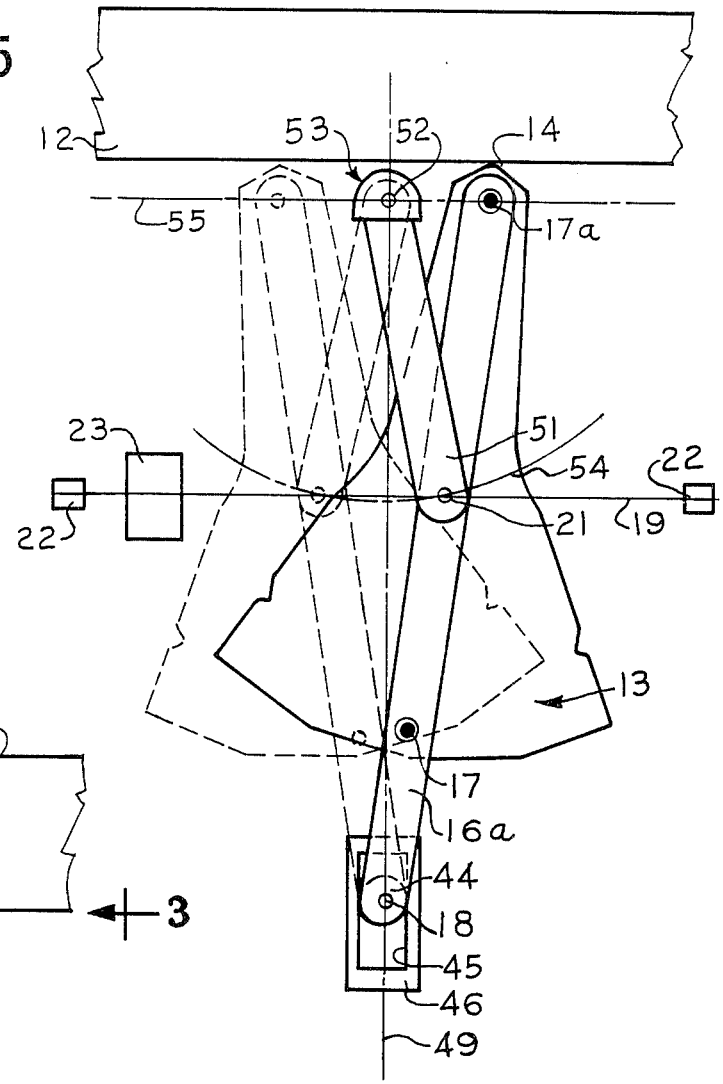
Figure 2:
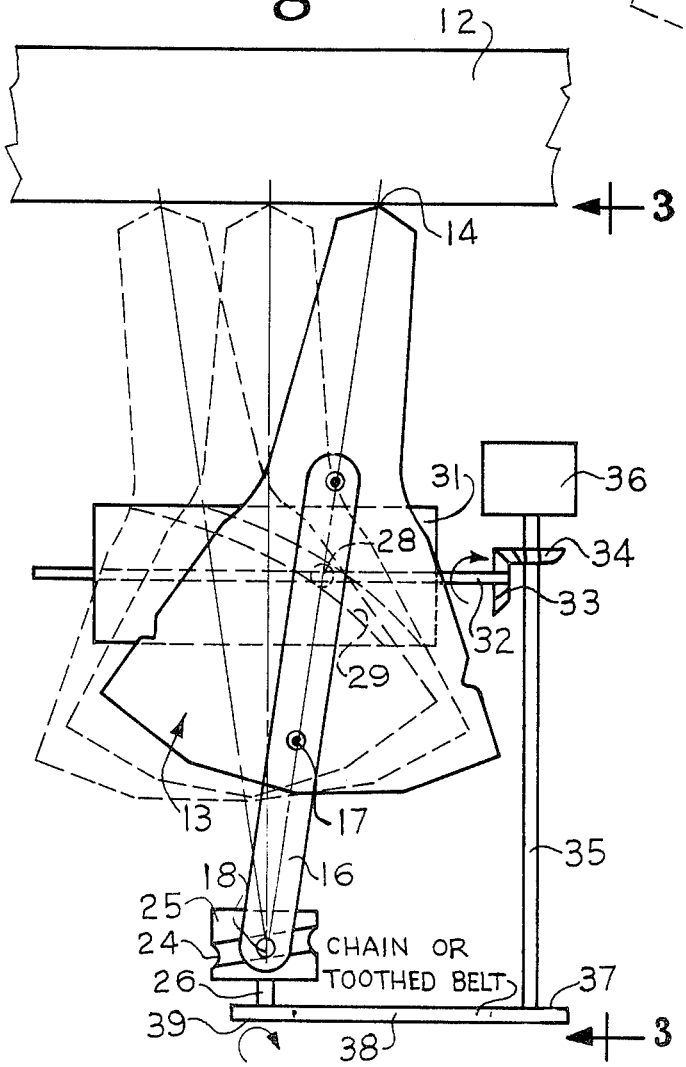
FIG. 2 is a plan view of a preferred embodiment of the invention employing cam means for oscillating the printing end of the head relative to a straight line platen and a cam driven synchronously with that cam means for moving the pivot for the print head toward and away from the platen to maintain the printing end spaced the same distance from the platen at all times.

FIG. 4 is a plan view similar to FIG. 2 of another embodiment of the invention with guide means constraining the printing end to straight line movement and means for guiding and spring loading the pivot of the print head for following shifting toward and away from the platen as the print head is oscillated about that pivot; and FIG. 5 is a plan view similar to FIGS. 2 and 4 of a further embodiment of the invention for use with a platen defining a straight printing line which employs a lever system interconnecting the print head and a pivot therefor guided for shifting toward and away from the platen as the print head is oscillated about it so as to maintain the printing end of the print head substantially the same distance from the platen at all times.

DETAILED DESCRIPTION OF THE INVENTION

Referring to FIG. 1, reference numeral 11 designates an arcuate platen in the shape of an arc of a circle or cylinder, while reference numeral 12 in FIGS. 2, 4 and 5 designates a platen with a flat planar surface defining a straight printing line, with both platens 11 and 12 comprising backing means for print-receiving media, not shown. That print-receiving media may be paper, and any suitable means for feeding or advancing it relative to the platen may be employed, with inking ribbon (also not shown) disposed in spaced relationship to the platen and movable relative thereto in any suitable arrangement and manner well known in the art.

For purposes of illustration, the means for effecting display of indicia in printing lines on the paper or other indicia-receiving media backed by the platens 11 or 12 comprises a print head, indicated generally by reference numeral 13, having printing means terminating at a printing end 14 and selectively operable in well known manner, as by means of individual solenoids 15 (FIG. 1). The present invention is not intended to be limited to any specific type of print head, since it may be used with all of the types previously referred to herein, such as that of U.S. Pat. No. 3,795,298 in which the printing means comprises a plurality of printing wires selectively operable longitudinally by individual solenoids as the print head moves across the platen. Rather than slidably translating the entire print head transversely back and forth across the platen as in the prior art, however, here the print head 13, regardless of the specific means employed for effecting display of indicia in printing lines on the print-receiving media, is pivotally mounted and oscillated about its pivot to move its printing end 14 laterally relative to the backing means 11 or 12 from a starting position for the length of a line of printing and return to the starting position.

To this end, the print head 13 is secured to a strap 16, or the like, as by rivets 17, and that strap is secured in any suitable manner to a vertical pivot 18, preferably near the forward end of the strap, which is the lower end as shown in the drawings. In FIG. 1, the pivot 18 is a fixed pivot, i.e. it is journalled for rotation only in a suitable bearing mounted on the machine frame in any desired manner. Thus, oscillation of the print head 13 and strap 16 about the pivot 18 will move the printing end 14 in a curved line across the arcuate platen or backing means 11, the axis of the pivot 18 being the center of the arcuate surface of platen 11 to insure uniform spacing of the printing end 14 from the platen at all times.

Any suitable motion translation means for so oscillating the rear or printing end 14 may be employed, that illustrated in FIG. 1 being simply an endless belt 19 secured as at 21 to the print head 13 or its strap 16 and threaded about idler wheels or pulleys 22 and driving means 23. The latter may be a combination of a synchronous or stepping motor for moving the printing head in a printing direction from starting position and a spring wound up by the motor for returning the print head to starting position upon deenergization of the motor at the completion of a line of printing. The starting position of the print head 13 is that illustrated in full lines at the right in FIG. 1 and an end of printing line position thereof is shown in broken lines therein. From this it will be appreciated that the force required to overcome the mass and inertia of the print head 13 in transversely moving the printing end 14 along lines of printing by merely oscillating the head about the pivot 18 is very materially less than required by the prior art devices which slide the entire print head to effect the same length of printing line movement of the printing end.

In the preferred embodiment of FIGS. 2 and 3, the motion translation means modifies the oscillation of the print head 13 about the pivot 18 to accommodate the invention to use with a platen having a flat planar surface by moving the pivot 18 relative to the media backing means or platen 12 in synchronism with the lateral moving of the printing end 14 to maintain the printing end spaced substantially the same distance from the flat planar surface of platen 12 at all times. To this end, the pivot 18 which depends from the strap 16 is supported by and engaged in a peripheral groove 24 in a drum cam 25, rather than being fixed as in the embodiment of FIG. 1. The drum 25 is secured to a shaft 26 rotatably supported in any suitable manner on the machine frame, as by means of bearing brackets 27 (FIG. 3).

The motion translation means for oscillating the printing end 14 of the print head 13 laterally relative to the platen 12 in this preferred embodiment of FIGS. 2 and 3 comprises drive means in the form of a pin 28 depending from the print head 13 and secured thereto, preferably at the center of gravity of the print head, and cam means shown as a drum cam 31 having a peripheral groove 29 engaging the lower end of the pin 28. The cam 31 is mounted on and secured to a shaft 32 having a bevel gear 33 fixed on one end which meshes with a similar gear 34 secured on a shaft 35 driven by a motor 36. The motor is mounted on the machine frame and the shafts 32 and 35 rotatably supported by the latter in any suitable manner. A gear 37 secured to the forward end of the shaft 35 drives a chain or toothed belt 38 which also engages a gear 39 fixed on the shaft 26.

Thus it will be seen that the motor 36 will rotate cam 31 to cause its groove 29 to move the pin 28 fixed to the print head 13 to oscillate the latter about the pivot 18 and swing the printing end 14 transversely relative to the platen 12 away from and back to a starting position while, at the same time, cam 25 will be rotated to cause its groove 24 to shift the pivot pin 18 away from and toward the platen 12. The directions of rotation of the cams 25 and 31 are indicated by suitable arrows in FIG. 2. The resulting synchronous rotation of cams 25 and 31 will maintain the printing end 14 of the print head 13 spaced substantially the same distance from the flat planar surface of the platen 12 at all times to assure proper and uniform printing at every point on a transverse line of printing across the print-receiving media.

FIG. 4 illustrates a further modification in which the print head 13 is swung back and forth about the pivot 18 transversely of the platen 12 by the same drive means 19, 21–23 previously described and shown in FIG. 1. To insure maintaining the printing end 14 of the head spaced the same distance from the platen 12 at all times, a guide pin 41 is secured to and depends from the head 13 near its rear printing end which is slidably disposed at its lower end in a slot 42 of a guide bar 43 rigidly connected to the machine frame in any suitable manner. To enable the desired pivotal movement of the print head while so limiting the oscillations of the printing end 15 to a straight line, the pivot 18 is permitted to move away from and toward the platen 12 and confined to such movement in a direction normal to the platen, as by means of a roller 44 rotatably mounted on the pivot 18 and movable in a slot 45 in a guide 46 that is secured to the machine frame. A spring 47 preferably is connected at one end to the pivot 18 and at the other end to the machine frame by a bracket 48. Thus, as the drive means 19, 21–23 oscillates the print head 13 about the pivot 18, the guide means 41–43 maintains the printing end 14 the same distance from the platen 12 at all times and causes shifting of the pivot 18 away from and toward the platen to enable such print head movements, the pivot shifting being confined to a direction normal or perpendicular to the platen and the printing line across it by the second guide means 44–46. The spring 47 assures proper contact of the guide pin 41 and slot 42 and avoids any chattering that might otherwise occur at the extremely high speed of printing operations attainable by using this invention.

Another modification is illustrated in FIG. 5 in which the same drive means 19, 21–23 as that of FIGS. 1 and 4 is employed to oscillate the print head 13 about its pivot 18. As in the FIG. 4 device, the modification of FIG. 5 employs a roller 44 on the pivot 18 engaging in a slot 45 in a stationary guide 46 to limit movement of the pivot away from and toward the platen 12 to a direction normal to the platen, with the vertical center line of the pivot 18, which is perpendicular to the horizontal plane of movement of print head 13, thus being confined to movement along a line 49 at right angles to a line of printing across the platen.

The means in this FIG. 5 device for transforming the arcuate movements of the printing end 14 effected by the drive means 19, 21–23 into linear movements substantially parallel to the straight printing line on platen 12 comprises a link 51 pivotally mounted at its forward end at the securing point 21 and at its rear end on a fixed pivot 52 supported by a bracket 53 on the machine frame. The strap 16 of the other modifications preferably is lengthened, and shown as **16*a* in FIG. 5 with one of the rivets 17*a* securing the print head to it near its forward end and the printing end 14. It will be appreciated that the oscillation of the securing point 21 will be confined by the link 51 to an arc 54 of a circle struck from the center of the fixed pivot 52. Consequently, as the print head 13 oscillates about its pivot 18, the latter will be moved away from and toward the platen 12 along the line 49 to maintain the printing end 14 substantially the same distance from the platen at all times. This is illustrated by a center line 55 drawn through the axis of the fixed pivot 52 parallel to the platen and perpendicular to the line 49 which extends through the axes of pivots 18 and 52. The rivet 17*a* is centered on that transverse line 55 and will be maintained thereon by the link 51 throughout the lateral movements of the printing end 14 of the print head 13.**

Thus, each of the modifications described and illustrated enables maximum speed of traverse of the printing end of a print head back and forth across the printing line and minimizes the force required by mounting the print head on a pivot and oscillating it thereon, instead of slidingly translating the entire print head back and forth across the printing line. This arrangement also minimizes the space requirements of the print head and its driving means, making it particularly advantageous for use in so-called mini calculators.

The embodiments of the invention in which an exclusive property or privilege is claimed are defined as follows:

1. In a high speed serial printer having backing means for print-receiving media, and means for effecting display of indicia in printing lines on said media, including a print head having a printing end and selectively operable printing means; motion translation means for oscillating said printing end of said print head laterally relative to said backing means from a starting position for the full length of a said line and return to said starting position, comprising a pivot for said print head having an axis of rotation substantially perpendicular to the plane of lateral movement of said print head, and drive means for oscillating said print head about said pivot, wherein said media backing means presents a straight surface and said motion translation means comprises pivot shifting means for moving said pivot relative to said media backing means in synchronism with the lateral moving of said printing end to thereby maintain said printing end spaced substantially the same distance from said straight surface at all times.

2. A high speed serial printer according to claim 1, wherein said drive means and said pivot shifting means comprise synchronously rotatable cam means.

3. In a high speed serial printer having a straight platen defining media backing means, printing means including a print head with a printing end, means movable selectively from said printing head toward and away from said backing means to effect printing on media backed by said backing means, and means for guiding translational movement of said print head whereby said printing end defines a printing line; the combination therewith of a pivot connected to said print head, and print head drive means for oscillating said print head on said pivot to effect translational movement of said printing end from a starting position along said line of printing and return to said starting position with a minimum expenditure of energy and comprising rotatable cam means and follower means driven thereby and connected to said print head and means for moving said pivot toward and away from said printing line in synchronism with said oscillating translational movements to maintain substantially constant spacing between said printing end and said media backing means.

4. A high speed serial printer according to claim 3, wherein ssaid means for moving said pivot comprises a second cam synchronously operable with said cam means.

5. A high speed serial printer having backing means for print-receiving media defining a straight printing line, printing means selectively operable to effect printing on said media, and a print head housing said printing means and having a printing end disposed adjacent said backing means; a pivot for said print head, means for imparting oscillating arcuate movements of printing line length to said printing end about said pivot, and control means operable synchronously with said last means to transform said arcuate movements of said printing end into linear movements thereof substantially parallel to said straight printing line.

6. A high speed serial printer according to claim 5, wherein said control means comprises means for positively guiding said printing end and means for permitting movement of said pivot away from and toward said platen while confining the same to a direction perpendicular to said printing line.

7. A printer according to claim 6, wherein said means for positively guiding said printing end comprises a pin secured to said print head and a stationary guide bar having a slot guidingly engaging said pin.

8. A printer according to claim 6, wherein said means for positively guiding said printing end comprises a fixed pivot, and a link rotatably mounted at one end on said fixed pivot and at its other end on said print head.

* * * * *